US005971522A

United States Patent [19]

Ono et al.

[11] Patent Number: 5,971,522

[45] Date of Patent: Oct. 26, 1999

[54] INK-JET HEAD FOR PROVIDING ACCURATE POSITIONING OF NOZZLES OF SEGMENT CHIPS ON A HOLDER

[75] Inventors: Masahiro Ono; Akihiko Miyaki; Takumi Kawamura, all of Kawasaki, Japan

[73] Assignee: Fujitsu Limited, Kanagawa, Japan

[21] Appl. No.: 08/948,255

[22] Filed: Oct. 9, 1997

[30] Foreign Application Priority Data

Mar. 19, 1997 [JP] Japan ..... 9-066911

[51] Int. Cl.[6] ..... B41J 2/01

[52] U.S. Cl. ..... 347/40; 347/20; 347/108

[58] Field of Search ..... 347/20, 40, 108

[56] References Cited

U.S. PATENT DOCUMENTS 5,189,437 2/1993 Michaelis et al. ..... 346/1.1

FOREIGN PATENT DOCUMENTS 0 214 720 3/1987 European Pat. Off. .
0 379 151 7/1990 European Pat. Off. .
43 09 255 9/1994 Germany .
2-62244 3/1990 Japan .
2-78559 3/1990 Japan .
7-40531 2/1995 Japan .

*Primary Examiner*—N. Le
*Assistant Examiner*—Lamson D. Nguyen
*Attorney, Agent, or Firm*—Armstrong, Westerman Hattori, McLeland & Naughton

[57] ABSTRACT

An ink-jet head includes a holder having first reference surfaces arrayed at a predetermined pitch in a main scanning direction. A plurality of segment chips is held on the holder. Each of the plurality of segment chips has an ink chamber plate and nozzles, each of the ink chamber plates having a flat surface on which grooves forming ink chambers are arrayed in a row perpendicular to the main scanning direction. Each of the ink chamber plates has a second reference surface extending from and coplanar with the flat surface. The second reference surfaces of the ink chamber plates of the plurality of segment chips are in contact with the first reference surfaces of the holder so that the nozzles of the respective segment chips are positioned on the holder at the pitch in the main scanning direction, and the plurality of segment chips are fixed to the holder.

11 Claims, 10 Drawing Sheets

INK-JET HEAD FOR PROVIDING ACCURATE POSITIONING OF NOZZLES OF SEGMENT CHIPS ON A HOLDER

BACKGROUND OF THE INVENTION (1) Field of the Invention

The present invention generally relates to ink-jet heads, and more particularly to an ink-jet head of a color printer which is used for various systems including copiers, facsimiles, computers, wordprocessors or the like.

(2) Description of the Related Art

Generally, an ink-jet head 10, as shown in FIG. 10A, has a yellow segment chip 12, a magenta segment chip 13, a cyan segment chip 14 and a black segment chip 15 which are held by a holder 11. These segment chips are arrayed in parallel in the holder 11 in this order. In FIG. 10A, "X" indicates a main scanning direction in which the ink-jet head 10 is moved, and "Y" indicates a sub-scanning direction in which a sheet of paper is delivered.

The segment chips 12, 13, 14 and 15 respectively include nozzles 12*a*, 13*a*, 14*a* and 15*a*. The nozzles of two of the segment chips 12–15 are spaced apart at a given distance in the main scanning direction X, and the nozzles for each of the segment chips 12–15 are spaced apart at a given distance in the sub-scanning direction Y. In FIG. 10A, "S" indicates a pitch between the nozzles of two of the segment chips 12 through 15 in the main scanning direction X.

FIG. 10B is an enlarged view of a portion "A" of the ink-jet head 10 of FIG. 10A. As shown in FIG. 10B, the arrangement of the nozzles of one of the segment chips 12–15 deviates from the arrangement of the nozzles of another segment chip with a given pitch in the sub-scanning direction Y. In FIG. 10B, "Q" indicates a pitch between the nozzles of the segment chips 12 through 15 in the sub-scanning direction Y.

If the ink-jet head 10 of the above-mentioned type is designed to provide a resolution of about 300 dpi (dots per inch), in order to produce an ink-jet head having this resolution, it is necessary to join together the holder 11 and the segment chips 12–15 with the pitch S being set within a tolerance of ±5 $\mu$m and the pitch Q being set within a tolerance of ±5 $\mu$m. Thus, the volume production of the ink-jet head 10 requires delicate assembly operations and accurate adjustments.

Therefore, in order to attain volume production, it is desired to provide a structure of an ink-jet head which provides a required level of accuracy for positioning the components at a low cost while requiring only simple assembly operations.

As disclosed in Japanese Laid-Open Patent Application No. 7-40531, a conventional method of production of an ink-jet head uses an automatic gripper and a positioning block. The ink-jet head has segment chips held by a holder, similar to the ink-jet head 10 of FIG. 10A. When the ink-jet head is assembled, the holder is fixed to the positioning block, and the automatic gripper holds and moves the segment chip relative to the positioning block. The segment chips are set by the automatic gripper at given locations within the holder. At this time, base plates attached to the segment chips are placed into grooves of the holders. The base plates attached to the segment chips are then bonded to the holder using adhesive agent.

In the conventional method of the above-mentioned publication, the structure of the ink-jet head is not adequate to provide accurate positioning of the nozzles of the segment chips on the holder. The base plates are bonded to the holder by the adhesive agent, and the pitch between the nozzles of the segment chips held on the holder may be affected by a curing condition of the adhesive agent. Further, the segment chips are fixed to the holder through the base plates, which may cause a deviation of the positions of the segment chips from the accurate positions of the nozzles. Therefore, it is difficult for the conventional method to provide accurate positioning of the nozzles of the segment chips on the holder.

Further, the conventional method of the above-mentioned publication has to use the automatic gripper to place the segment chips on the holder, and it is difficult for the conventional method to produce the ink-jet head at a low cost.

SUMMARY OF THE INVENTION

An object of the present invention is to provide an improved ink-jet head in which the above-mentioned problems are eliminated.

Another object of the present invention is to provide an ink-jet head which provides a required level of accuracy for positioning nozzles of segment chips on a holder at a low cost while requiring simple assembly operations.

Still another object of the present invention is to provide an ink-jet head production method which provides a required level of accuracy for positioning nozzles of segment chips on a holder at a low cost while requiring simple assembly operations.

The above-mentioned objects of the present invention are achieved by an ink-jet head which comprises: a holder having first reference surfaces arrayed at a predetermined pitch in a main scanning direction; and a plurality of segment chips held on the holder, each of the plurality of segment chips having an ink chamber plate and nozzles, each of the ink chamber plates having a flat surface on which grooves forming ink chambers are arrayed in a row perpendicular to the main scanning direction, each of the ink chamber plates having a second reference surface extending from and coplanar with the flat surface, wherein the second reference surfaces of the ink chamber plates of the plurality of segment chips are in contact with the first reference surfaces of the holder so that the nozzles of the respective segment chips are positioned on the holder at the predetermined pitch in the main scanning direction, and the plurality of segment chips are fixed to the holder.

The above-mentioned objects of the present invention are achieved by an ink-jet head manufacturing method which comprises the steps of: preparing a holder having first reference surfaces arrayed at a predetermined pitch in a main scanning direction; preparing a plurality of segment chips, each of the plurality of segment chips having an ink chamber plate and nozzles, each of the ink chamber plates having a flat surface on which grooves forming ink chambers are arrayed in a row perpendicular to the main scanning direction, each of the ink chamber plates having a second reference surface extending from and coplanar with the flat surface; positioning the nozzles of the respective segment chips on the holder at the predetermined pitch in the main scanning direction by placing the second reference surfaces of the ink chamber plates of the plurality of segment chips into contact with the first reference surfaces of the holder; and fixing the plurality of segment chips to the holder.

In the ink-jet head of the present invention, only the predetermined pitch between the first reference surfaces for the holder is given as accurate dimensions, and the dimensions of other areas of the holder can be made relatively rough. It is possible to easily produce the holder at a low cost. In the ink-jet head of the present invention, only the second reference surfaces for the segment chips are given as accurate areas, and the dimensions of other areas of the segment chips, such as the thickness of the ink chamber plate, does not affect the accuracy of the pitch of the nozzles in the main scanning direction. The dimensions of other areas of the segment chips can be made relatively rough. It is possible to easily produce the segment chips at a low cost.

In the ink-jet head of the present invention, the second reference surfaces of the segment chips are in contact with the first reference surfaces of the holder so that the nozzles of the segment chips are positioned on the holder in the main scanning direction. It is not necessary to use a special positioning device for positioning the segment chips on the holder in the main scanning direction. The ink-jet head of the present invention can provide a required level of accuracy for positioning the nozzles of the segment chips on the holder at a low cost while requiring only simple assembly operations. The structure of the ink-jet head is appropriate for volume production.

According to the ink-jet head production method of the present invention, it is possible to easily join together the holder and the segment chips with the predetermined pitch of the nozzles in the main scanning direction being set within a required level of accuracy. It is possible for the ink-jet head of the present invention to provide a required level of resolution.

BRIEF DESCRIPTION OF THE DRAWINGS

The above and other objects, features and advantages of the present invention will become more apparent from the following detailed description when read in conjunction with the accompanying drawings in which.

DESCRIPTION OF THE PREFERRED EMBODIMENTS

A description will now be given of the preferred embodiments of the present invention with reference to the accompanying drawings.

Figure 1:
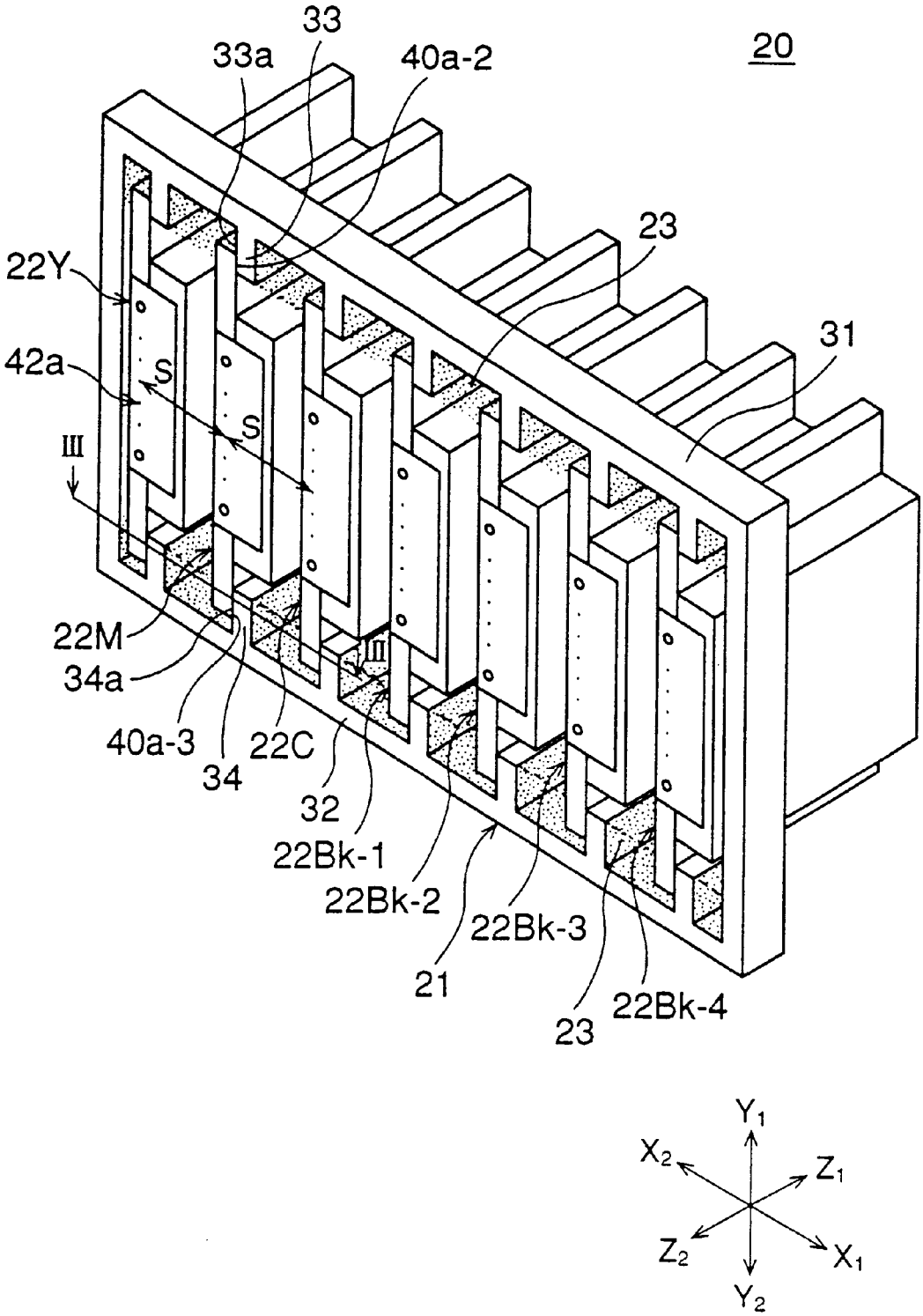
FIG. 1 is a view of a first embodiment of an ink-jet head of the present invention.
Figure 2B:
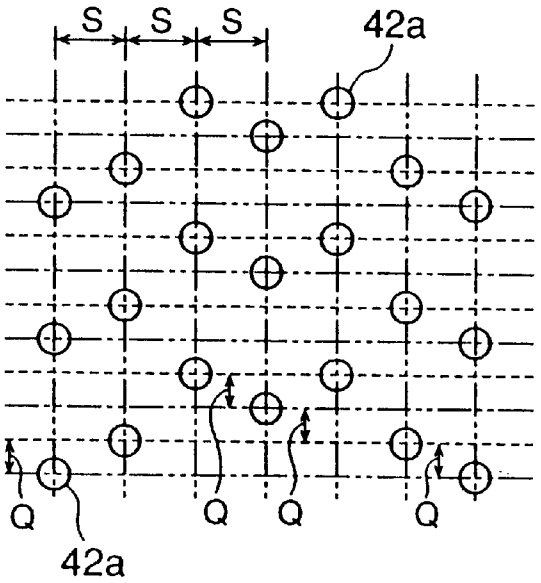
FIG. 2A and FIG. 2B are diagrams for explaining an arrangement of nozzles of the ink-jet head of FIG. 1.
Figure 2A:
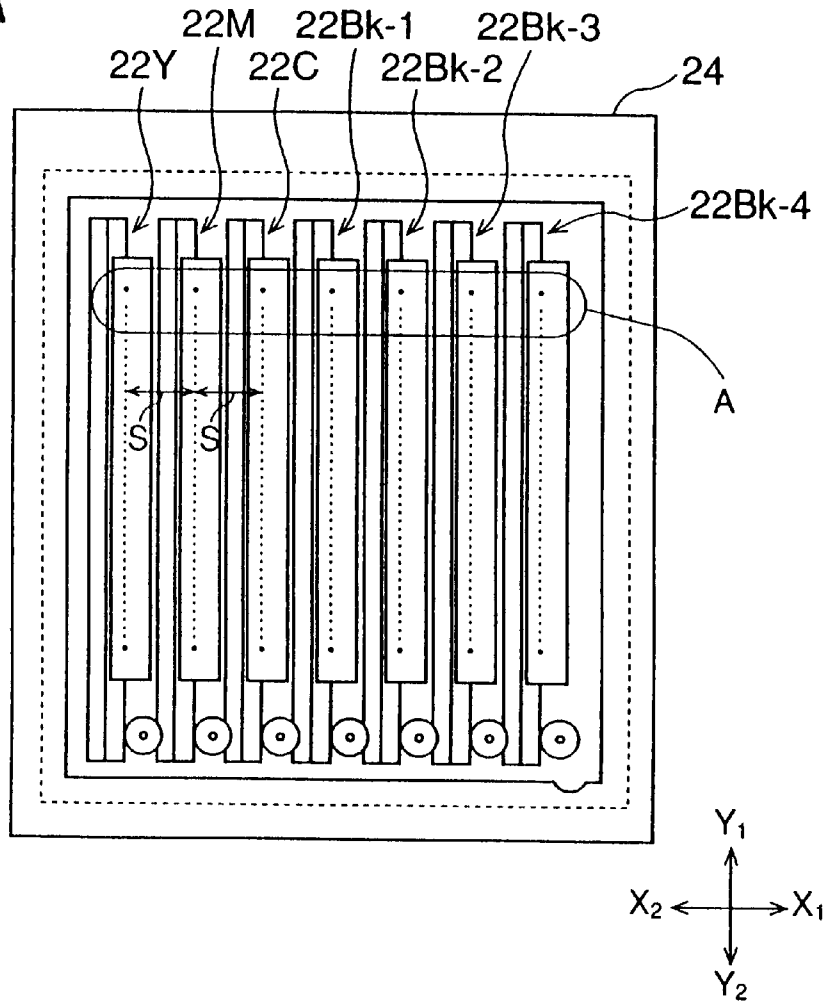
Figure 3:
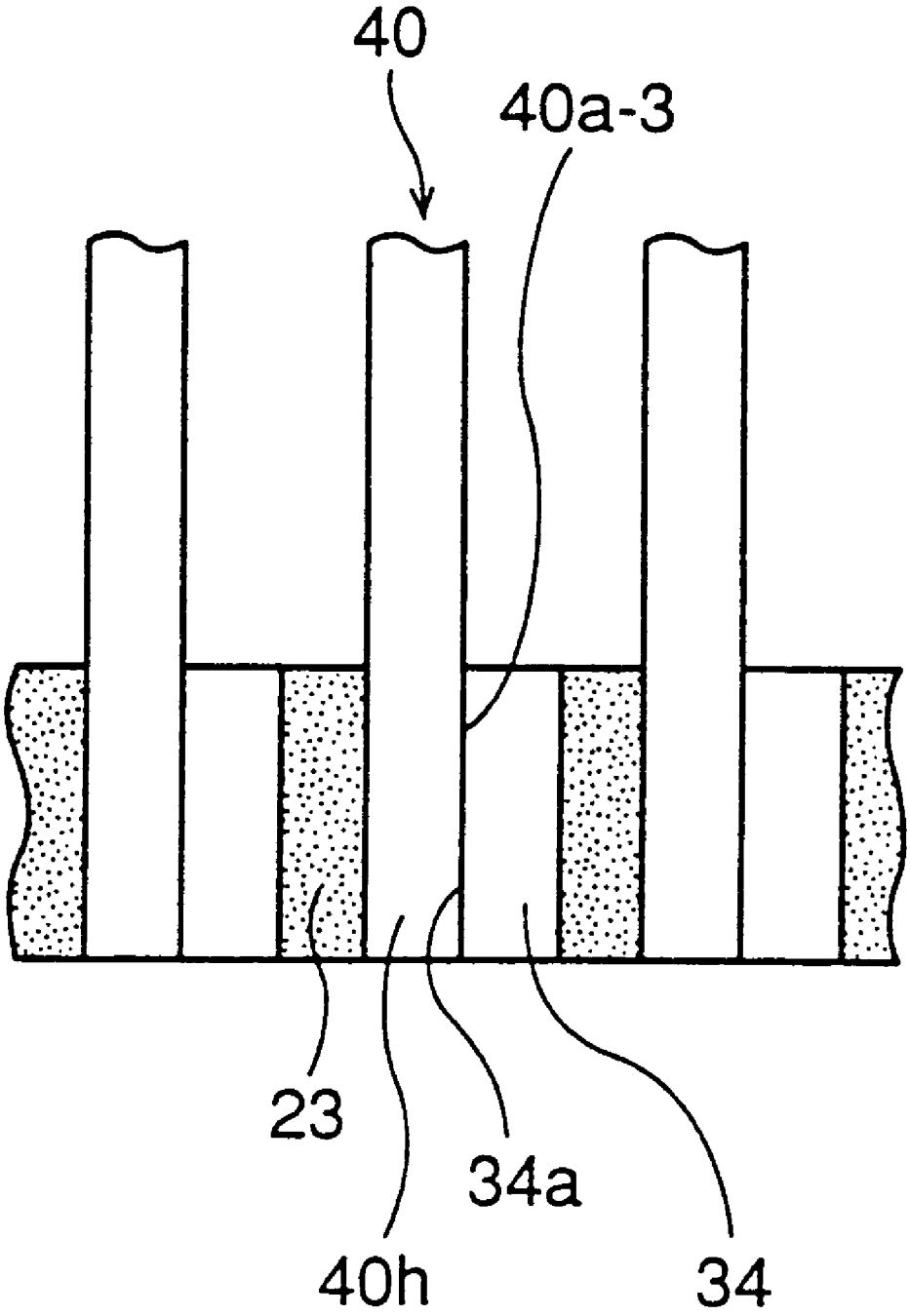
FIG. 3 is a cross-sectional view of the ink-jet head taken along a line III—III indicated in FIG.1.

FIG. 1 shows a first embodiment of an ink-jet head of the present invention. FIG. 2A and FIG. 2B show an arrangement of nozzles of the ink-jet head of FIG. 1. FIG. 2B is an enlarged view of a portion "A" of the ink-jet head 20 of FIG. 2A. FIG. 3 is a cross-sectional view of the ink-jet head taken along a line III—III indicated in FIG. 1.

As shown in FIG. 1, the ink-jet head 20 of the present embodiment includes a yellow segment chip 22Y, a magenta segment chip 22M, a cyan segment chip 22C and four black segment chips 22Bk-1, 22Bk-2, 22Bk-3 and 22Bk-4 which are held on a holder 21. These segment chips are arrayed in parallel in the holder 21 in the above-mentioned order. In FIG. 1, "X1" (or "X2") indicates a main scanning direction in which the ink-jet head 20 is moved, and "Y1" (or "Y2") indicates a sub-scanning direction in which a sheet of paper is delivered, and "Z1" (or "Z2") indicates a direction of depth of the ink-jet head 20 perpendicular to both the main scanning direction and the sub-scanning direction.

Each of the segment chips 22Y through 22Bk-4 includes nozzles 42*a*. The nozzles 42*a* of two of the segment chips 22Y through 22Bk-4 are spaced apart at a given distance in the main scanning direction X1 (or X2). In FIG. 2A, "S" indicates a pitch between the nozzles of two adjacent ones of the segment chips 22Y through 22Bk-4 in the main scanning direction X1 (or X2).

As shown in FIG. 2B, the arrangement of the nozzles 42*a* of one of the segment chips 22Y through 22Bk-4 deviates from the arrangement of the nozzles 42*a* of another segment chip with a given distance in the sub-scanning direction Y1 (or Y2). In FIG. 2B, "Q" indicates a pitch (or a minimum distance) between the nozzles 42*a* of two different ones of the segment chips 22Y through 22Bk-4 in the sub-scanning direction Y1 (or Y2).

In the ink-jet head 20 of this embodiment, the segment chips 22Y through 22Bk-4 are positioned on the holder 21 and bonded to the holder 21 using adhesive agent 23 as shown in FIG. 1 and FIG. 3. The segment chips 22Y through 22Bk-4 and the holder 21 are covered with a case 24 shown in FIG. 2.

Figure 4:
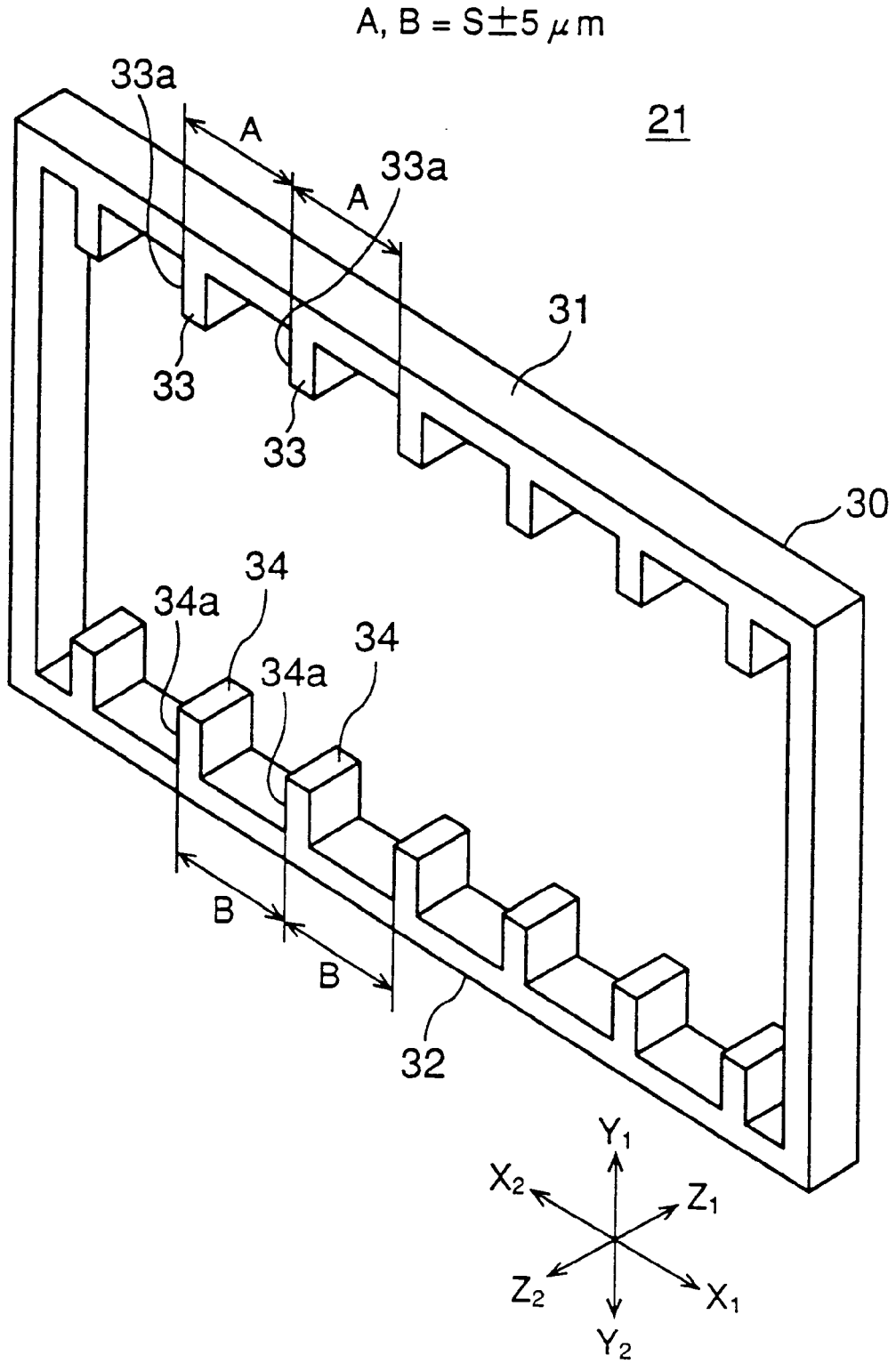
FIG. 4 is a diagram showing a holder of the ink-jet head of FIG. 1.

FIG. 4 shows a structure of the holder 21 of the ink-jet head of FIG. 1. The holder 21 of this embodiment is a resin-molded product containing a glass filler.

As shown in FIG. 4, the holder 21 includes a rectangular frame 30 with an upper side 31 and a lower side 32. Seven upper ribs 33 extend downward from an internal surface of the upper side 31, and seven lower ribs 34 extend upward from an internal surface of the lower side 32 and are spaced apart from each other along the lower side 32. The upper ribs 33 and the lower ribs 34 confront each other. The upper ribs 33 are spaced apart along the upper side 31 at a given distance "A" in the main scanning direction X1 (or X2), and the lower ribs 34 are also spaced apart along the lower side 32 at a given distance "B" in the main scanning direction X1 (or X2).

Each of the upper ribs 33 has a left-hand side surface 33*a*, and the distance A is measured between the side surfaces 33*a* of two of the ribs 33 in the main scanning direction X1 (or X2). Each of the lower ribs 34 has a left-hand side surface 34*a*, and the distance B is measured between the side surfaces 34*a* of two of the ribs 34 in the main scanning direction X1 (or X2). In the holder 21, the distance A between two of the ribs 33 and the distance B between two of the ribs 34 are given as accurate dimensions. Specifically, the distance A is set to be within a range of S ±5 $\mu$m where S is the pitch between the nozzles of two of the segment chips 22Y through 22Bk-4 in the main scanning direction X1 (or X2). The distance B is also set to be within a range of S ±5 $\mu$m. Further, in the holder 21, the side surface 33*a* and the side surface 34*a* with respect to each of the ribs 33 and the ribs 34 which confront each other are set to be coplanar.

Hereinafter, the side surfaces 33*a* and the side surfaces 34*a* in the holder 21 of the present embodiment are called first reference surfaces 33*a* and 34*a* for the ink-jet head 20 of the present invention.

In the holder 21 of the present embodiment, only the distance A between two of the ribs 33 and the distance B between two of the ribs 34 are given as accurate dimensions, and the dimensions of other areas may be made relatively rough. It is possible to easily produce the holder 21 of the present embodiment at a low cost.

Figure 5A:
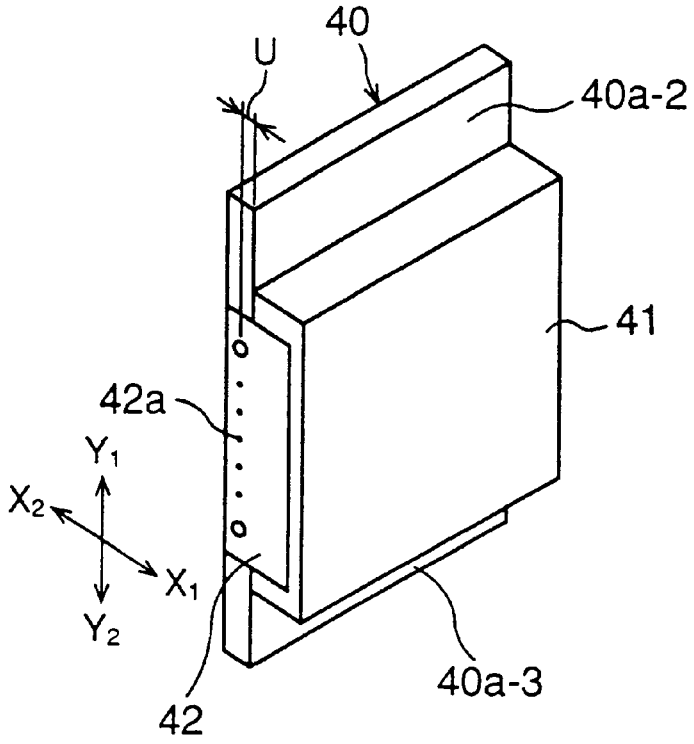
FIG. 5A and FIG. 5B are diagrams showing one of segment chips of the ink-jet head of FIG. 1.
Figure 5B:
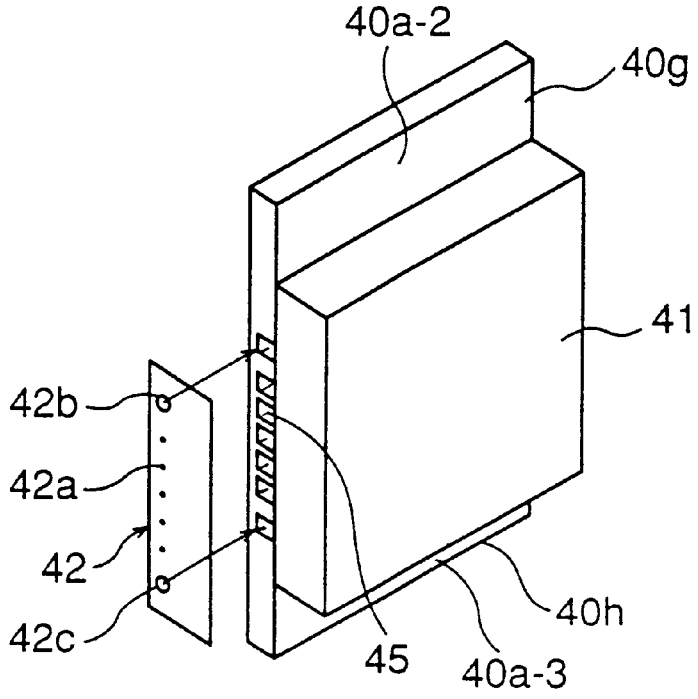
Figure 6:
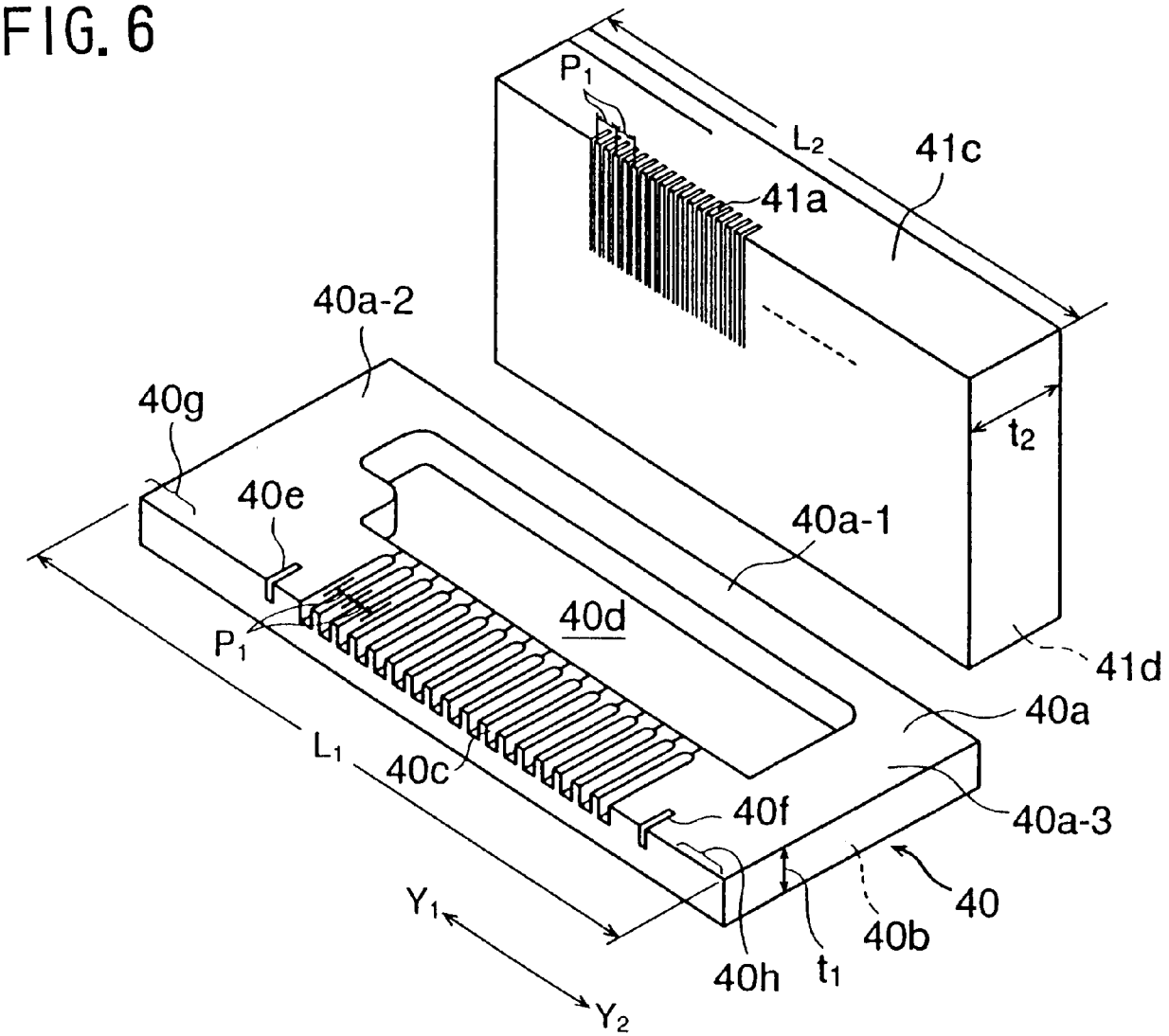
FIG. 6 is a diagram for explaining an arrangement of the segment chip of FIG. 5A.

FIG. 5A shows the yellow segment chip 22Y as one of various segment chips contained in the ink-jet head 20 of FIG. 1. FIG. 5B is an exploded view of the segment chip 22Y of FIG. 5A. FIG. 6 shows an arrangement of elements of the segment chip 22Y of FIG. 5A.

As shown in FIG. 5A, the segment chip 22Y has an ink chamber plate 40, a piezoelectric unit 41 and a nozzle plate 42.

The ink chamber plate 40 is made of a rectangular glass plate having a flat surface 40*a* on the top side and a flat surface 40*b* on the bottom side. As shown in FIG. 6, the ink chamber plate 40 has a thickness "t1". A large-size glass plate is subjected to half etching, and grooves and an opening are formed in the glass plate. The ink chamber plate 40 has a longitudinal length "L1" that is greater than a longitudinal length "L2" of the piezoelectric unit 41.

As shown in FIGS. 5B and 6, grooves 40*c* and an opening 40*d* are formed in a middle portion 40*a*-1 of the flat surface 40*a* of the ink chamber plate 40. The grooves 40*c* are arrayed in a longitudinal direction of the ink chamber plate 40 and spaced apart at a pitch "P1" in the sub-scanning direction Y1 (or Y2). Each of the grooves 40*c* forms one of ink chambers 45 (indicated in FIG. 5B) contained in the ink chamber plate 40. The opening 40*d* forms a part of a common passage (which is indicated by reference numeral 46 in FIG. 9B) of the ink-jet head 20. Further, a locating groove 40*e* and a locating groove 40*f* are formed at upper and lower ends of the middle portion 40*a*-1 of the flat surface 40*a*. The locating grooves 40*e* and 40*f* serve to position the nozzle plate 42 on the ink chamber plate 40.

The piezoelectric unit 41 is made of a rectangular plate. As shown in FIG. 6, the piezoelectric unit 41 has a thickness "t2". The piezoelectric unit 41 includes a plurality of displacement portions 41*a* which are arrayed in a longitudinal direction of the piezoelectric unit 41 and spaced apart at the pitch "P1" (which is the same as the pitch of the grooves 40*c*) in the sub-scanning direction Y1 (or Y2). The piezoelectric unit 41 is secured to the flat surface 40*a* of the ink chamber plate 40 so that the displacement portions 41*a* respectively confront the grooves 40*c* of the ink chamber plate 40.

Each of the displacement portions 41*a* of the piezoelectric unit 41 includes electrodes electrically connected to a drive circuit (not shown) of a printer. Each displacement portion 41*a* is movable in response to an electric signal supplied from the drive circuit. When a related one of the displacement portions 41*a* is moved in response to the signal from the drive circuit, ink from a related one of the ink chambers 45 of the ink chamber plate 40 is discharged from a related one of the nozzles 42*a* of the nozzle plate 42 by the movement of the related displacement portion 41*a*.

The nozzle plate 42 has, as shown in FIG. 5A and FIG. 5B, the nozzles 42*a* which are arrayed in a longitudinal direction of the nozzle plate 42 and spaced apart at a pitch (which is the same as the pitch "P1" of the grooves 40*c*) in the sub-scanning direction Y1 (or Y2). The nozzle plate 42 further includes a locating hole 42*b* and a locating hole 42*c* at upper and lower ends of the nozzle plate 42. The locating holes 42*b* and 42*c* are located outside the nozzles 42*a* of the nozzle plate 42.

The nozzle plate 42 is attached to the ink chamber plate 40 by fastening locating pins. As shown in FIG. 5B, locating pins (not shown) are passed through the locating holes 42*b* and 42*c* of the nozzle plate 42 and are fitted to the locating grooves 40*e* and 40*f* of the ink chamber plate 40. The nozzle plate 42 is thus fixed to the ink chamber plate 40 so that each of the nozzles 42*a* confronts one of the ink chambers 45 contained in the ink chamber plate 40.

In the above-described segment chip 22Y, the flat surface 40*a* of the ink chamber plate 40 has an upper portion 40*a*-2 and a lower portion 40*a*-3 which are not covered by the piezoelectric unit 41, as shown in FIG. 5A and FIG. 5B. In the upper portion 40*a*-2 of the flat surface 40*a*, an exposed region 40*g* of the ink chamber plate 40 is formed and extends from the top of the piezoelectric unit 41. In the lower portion 40*a*-3 of the flat surface 40*a*, an exposed region 40*h* of the ink chamber plate 40 is formed and extends downwardly from the bottom of the piezoelectric unit 41.

The upper portion 40*a*-2, the middle portion 40*a*-1 and the lower portion 40*a*-3 are coplanar with the flat surface 40*a* of the ink chamber plate 40, and the grooves 40*c* and the locating grooves 40*e* and 40*f* are formed on the flat surface 40*a* of the ink chamber plate 40. When the nozzle plate 42 is fixed to the ink chamber plate 40, it is possible to accurately position the nozzles 42*a* on the ink chamber plate 40. Specifically, in the present embodiment, a distance "U" (indicated in FIG. 5A) between the centerline of the nozzle holes 42*a* of the nozzle plate 42 and the flat surface 40*a* of the ink chamber plate 40 in the main scanning direction X1 (or X2) is set to be a predetermined dimension at a required level of accuracy. Therefore, it is possible to provide a high level of accuracy for positioning the nozzles 42*a* to the upper portion 40*a*-2 and the lower portion 40*a*-3 of the flat surface 40*a* of the ink chamber plate 40.

Hereinafter, the upper portion 40*a*-2 and the lower portion 40*a*-3 of the flat surface 40*a* for each of the segment chips 22Y through 22Bk-4 of the present embodiment are called second reference surfaces 40*a*-2 and 40*a*-3 for the ink-jet head 20 of the present invention.

In the ink-jet head 20 of the present embodiment, the other segment chips 22M through 22Bk-4 are constructed in the same manner as the segment chip 22Y of FIG. 5A through FIG. 6.

When assembling the ink-jet head 20 of the present embodiment, the segment chips 22Y through 22Bk-4 are positioned on the holder 21 in the sub-scanning direction Y1 (or Y2) by using a positioning jig (not shown). At the same time, the segment chips 22Y through 22Bk-4 are positioned on the holder 21 in the main scanning direction X1 (or X2) by bringing the second reference surfaces 40*a*-2 and 40*a*-3 of the segment chips 22Y through 22Bk-4 into contact with the first reference surfaces 33*a* and 34*a* of the ribs 33 and the ribs 34 of the holder 21, as shown in FIG. 3.

By assembling the ink-jet head 20 of the present embodiment in this manner, it is possible for the present embodiment to join together the holder 21 and the segment chips 22Y through 22Bk-4 with the pitch S of the nozzles 42*a* in the main scanning direction X1 (or X2) being set within a tolerance of ±5 μm and the pitch Q of the nozzles 42*a* in the sub scanning direction Y1 (or Y2) being set within a tolerance of ±5 μm. It is possible for the ink-jet head 20 of the present embodiment to provide a resolution of about 300 dpi. The value of the pitch S may vary depending on a scanning speed of the ink-jet head 20 and a drive timing of the ink-jet head 20.

In the ink-jet head 20 of the present embodiment, the second reference surfaces 40*a*-2 and 40*a*-3 of the segment chips 22Y through 22Bk-4 are contacted with the first reference surfaces 33*a* and 34*a* of the holder 21 in order to position the nozzles of the segment chips 22Y through 22Bk-4 on the holder 21 in the main scanning direction X1 (or X2). It is not necessary to use a special positioning device for positioning the segment chips 22Y through 22Bk-4 on the holder 21 in the main scanning direction X1 (or X2). The ink-jet head 20 of the present embodiment can provide the required level of accuracy for positioning the nozzles 42*a* of the segment chips 22Y through 22Bk-4 on the holder 21 at a low cost while requiring only simple assembly operations. The structure of the ink-jet head 20 is appropriate for volume production.

In the ink-jet head 20 of the present embodiment, the second reference surfaces 40*a*-2 and 40*a*-3 of the segment chips are contacted by the first reference surfaces 33*a* and 34*a* of the holder, and the positions of the nozzles 42*a* in the main scanning direction X1 (or X2) are not affected by the curing condition of the adhesive agent 23.

In the ink-jet head 20 of the present embodiment, the thickness "t1" of the ink chamber plate 40 and the thickness "t2" of the piezoelectric unit 41 do not affect the accuracy of the pitch S of the nozzles 42*a* in the main scanning direction X1(or X2). The thicknesses "t1" and "t2" of the segment chips 22Y through 22Bk-4 can be made relatively rough. It is possible to easily produce the segment chips 22Y through 22Bk-4 of this embodiment at a low cost.

Figure 7:
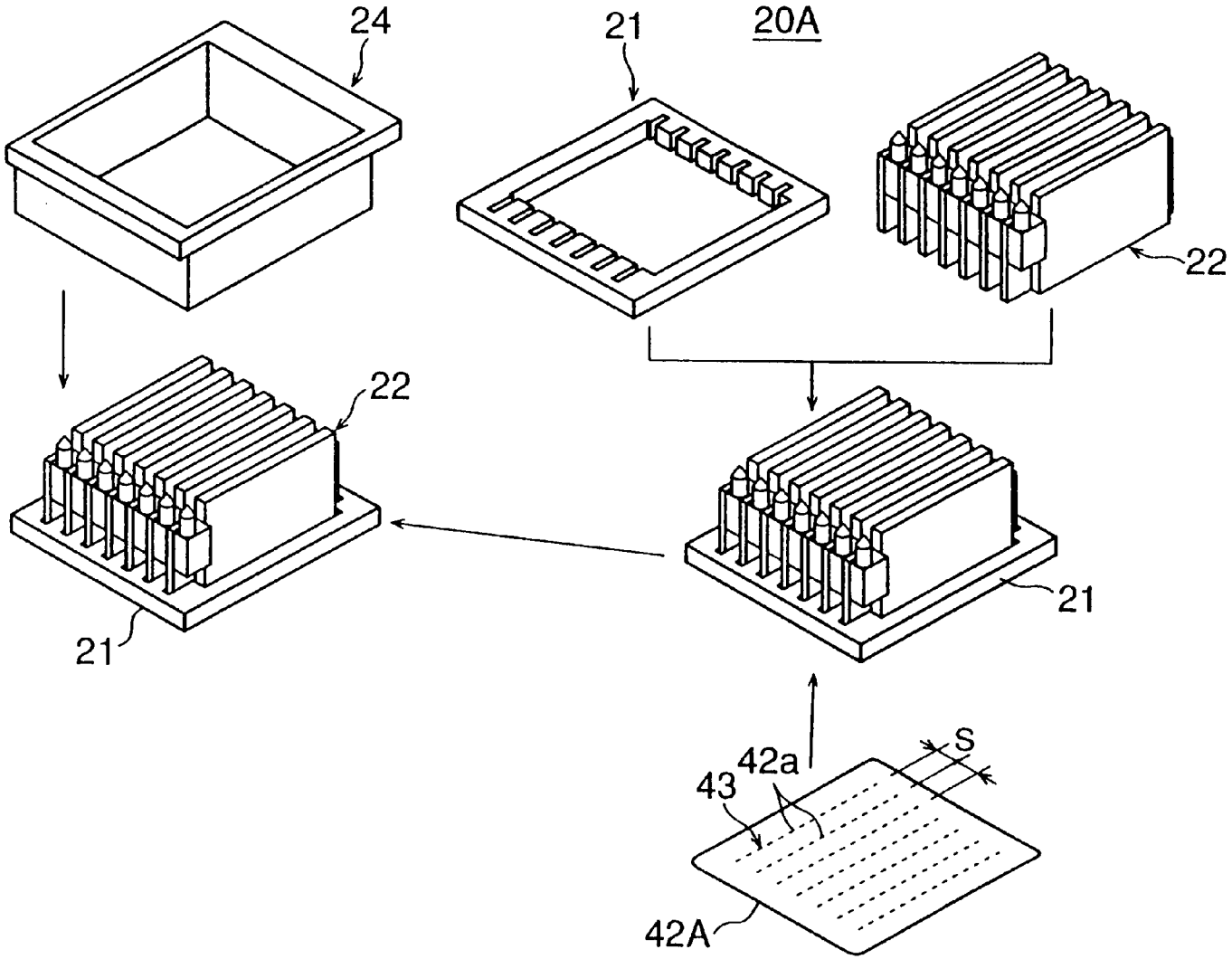
FIG. 7 is a diagram for explaining a second embodiment of the ink-jet head of the present invention.
Figure 8:
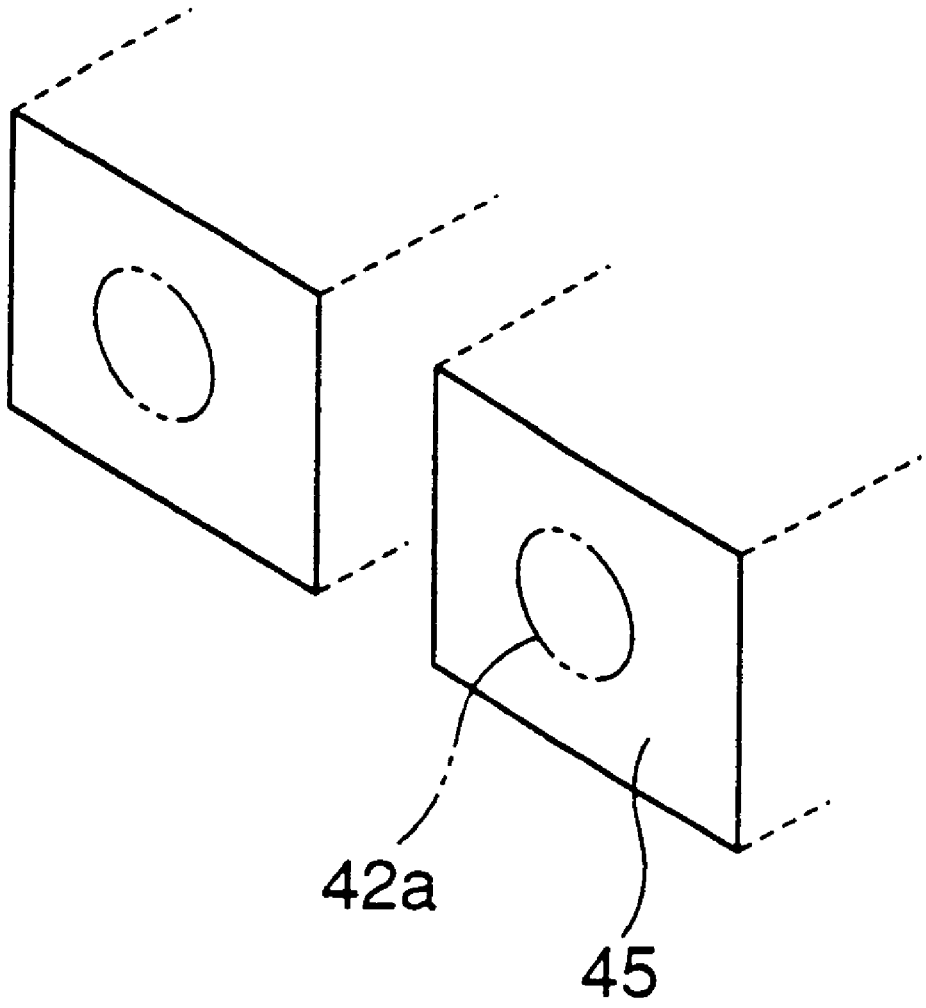
FIG.8 is a diagram for explaining a relationship between nozzles and ink chambers of the ink-jet head of FIG. 7.

FIG. 7 shows a second embodiment of the ink-jet head of the present invention. FIG. 8 shows a relationship between nozzles and ink chambers of the ink-jet head of FIG. 7. In FIG. 7 and FIG. 8, the elements which are the same as corresponding elements in FIG. 1 and FIG. 2A are designated by the same reference numerals, and a description thereof will be omitted.

As shown in FIG. 7, an ink-jet head 20A of this embodiment includes the seven segment chips 22 (which are the same as the segment chips 22Y through 22Bk-4 in FIG. 1) held on the holder 21. The segment chips 22 are arrayed in parallel on the holder 21.

The segment chips 22 of the present embodiment do not include a separate nozzle plate having the nozzles 42*a*. A common nozzle plate 42A is provided instead of the separate nozzle plates 42 of the first embodiment. The common nozzle plate 42A has the nozzles 42*a* arrayed in seven rows for the above segment chips 22 and has a size adequate to cover all the segment chips 22.

In the ink-jet head 20A of the present embodiment, after the segment chips 22 are positioned and held on the holder 21 in the same manner as those of the first embodiment, the common nozzle plate 42A is positioned and fixed to the segment chips 22.

In FIG. 7, reference numeral 43 indicates one of the rows of the nozzles 42*a* in the common nozzle plate 42A. In the common nozzle plate 42A, the nozzles 42*a* are arrayed in seven rows, each row having a number of nozzles 42*a*. The pitch S of the nozzles 42*a* of two rows in the common nozzle plate 42A is set within a tolerance of ±5 μm similar to the pitch S of the nozzles 42*a* of the first embodiment.

As shown in FIG. 8, one of the nozzles 42*a* of the common nozzle plate 42A has a size that is about half the size of one of the ink chambers 45 of the segment chips 22. In the present embodiment, the accuracy of the positions of the nozzles 42A is determined when the nozzles 42A are formed in the common nozzle plate 42A. The accuracy for positioning the segment chips 22 on the holder 21 can be made relatively rough. For example, the positions of the segment chips 22 to the holder 21 may be set within a tolerance of ±15 μm.

In the ink-jet head 20A of the present embodiment, it is possible to provide the required level of accuracy for positioning the nozzles 42*a* of the segment chips 22 on the holder 21 with a further reduced cost while requiring simple assembly operations.

Figure 9A:
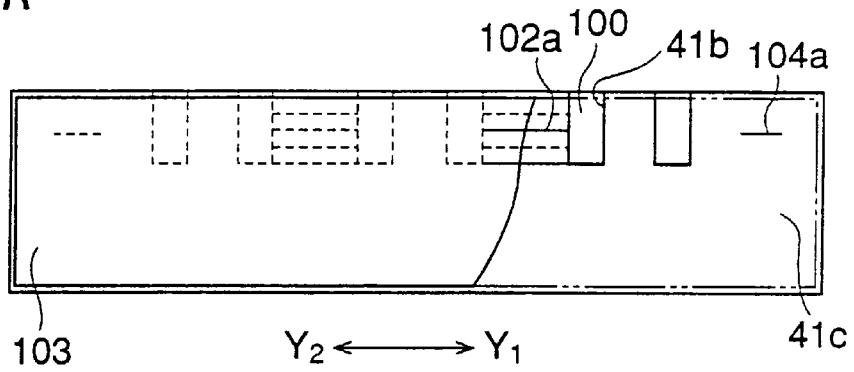
FIG. 9A through FIG. 9C are diagrams for explaining an arrangement of electrodes of a piezoelectric unit of the segment chip of FIG. 5A.
Figure 9B:
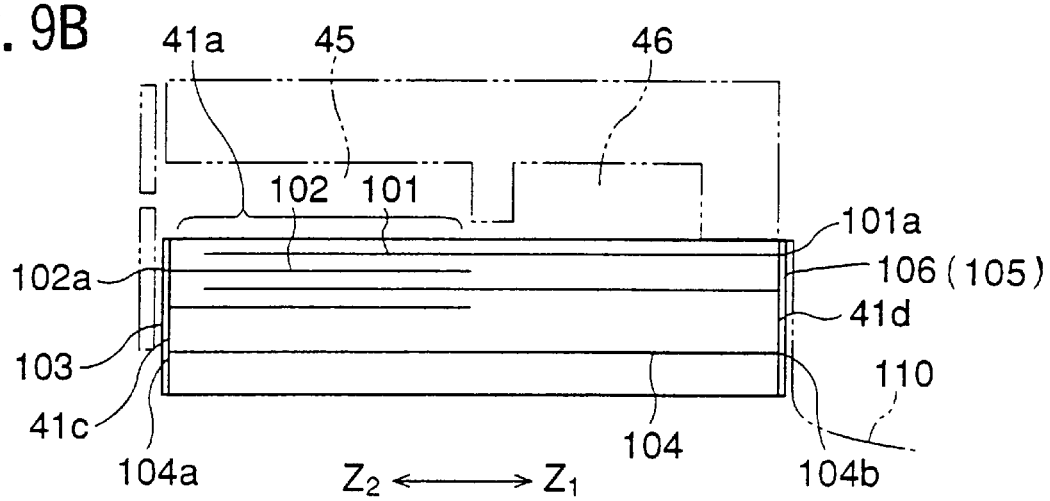
Figure 9C:
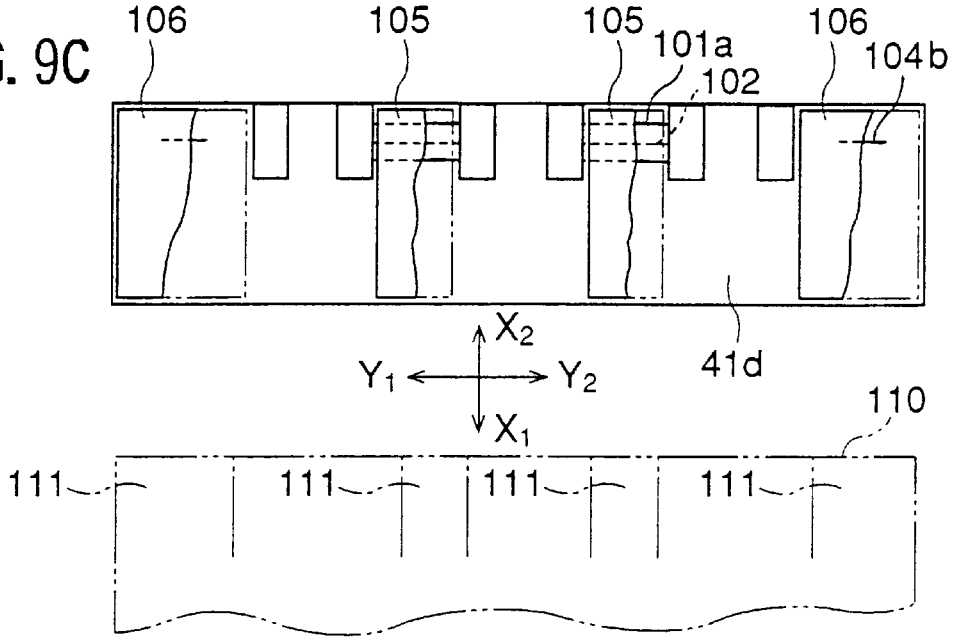
Figure 10B:
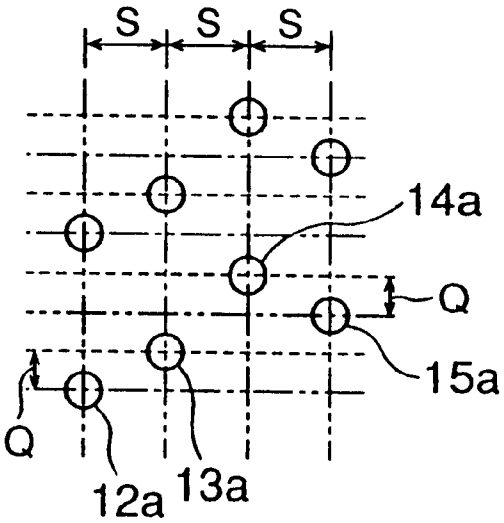
FIG. 10B PRIOR ART
FIG. 10A and FIG. 10B are diagrams for explaining an arrangement of nozzles of a conventional ink-jet head.
Figure 10A:
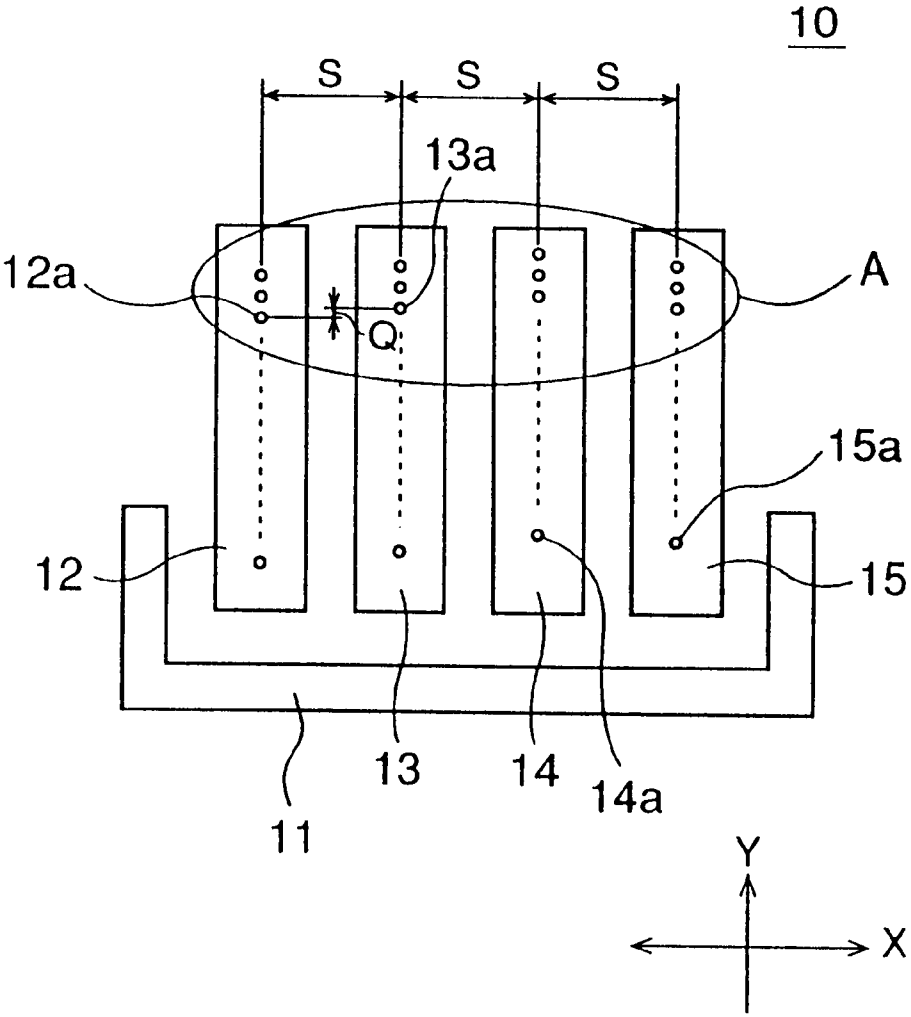
FIG. 10A PRIOR ART

FIG. 9A through FIG. 9C show an arrangement of electrodes of the piezoelectric unit 41 of FIG. 5A. FIG. 9A is a front view of the piezoelectric unit 41 of FIG. 5A, FIG. 9B is an enlarged side view of one of the displacement portions 41*a* of the piezoelectric unit 41, and FIG. 9C is a rear view of the piezoelectric unit 41 of FIG. 5A.

As shown in FIGS. 9A, 9B and 9C, the displacement portions 41*a* (indicated in FIG. 9B) of the piezoelectric unit 41 are separated from each other by grooves 41*b* arrayed in the longitudinal direction of the piezoelectric unit 41. The grooves 41*b* are filled with silicon 100.

For each of the displacement portions 41*a* of the piezoelectric unit 41, as shown in FIG. 9B, individual electrode layers 101 and common electrode layers 102 are alternately formed. The individual electrode layers 101 are individually provided for each of the displacement portions 41*a*. The individual electrode layers 101 extend to a rear surface 41*d* of the piezoelectric unit 41 in the direction Z1, and ends 101*a* of the individual electrode layers 101 are exposed on the rear surface 41*d*. The common electrode layers 102 extend to a front surface 41*c* of the piezoelectric unit 41 in the direction Z2, and ends 102*a* of the common electrode layers 102 are exposed on the front surface 41*c*.

Further, in the piezoelectric unit 41, a routing wire pattern 104 extending in the direction Z1 (or Z2) is formed, and an end 104*a* of the routine wire pattern 104 is exposed on the front surface 41*c* of the piezoelectric unit 41, and an end 104*b* of the routine wire pattern 104 is exposed on the rear surface 41*d* of the piezoelectric unit 41. In FIG. 9B, the position of the routing wire pattern 104 which is lower than the actual position thereof in the displacement portion 41*a* is shown for the sake of convenience.

A front common electrode 103, as shown in FIG. 9A, is formed on the entire front surface 41*c* of the piezoelectric unit 41. The front common electrode 103 is electrically connected to the ends 102*a* of the common electrode layers 102 and the end 104*a* of the routing wire pattern 104. The routing wire pattern 104 serves to route the front common electrode 103 from the front surface 41*c* to the rear surface 41*d* of the piezoelectric unit 41.

As shown in FIG. 9C, individual electrodes 105 and rear common electrodes 106 are formed on the rear surface 41*d* of the piezoelectric unit 41. In FIG. 9C, the individual electrodes 105 and the rear common electrodes 106 are partially cut away for the sake of convenience of description. The individual electrodes 105 and the rear common electrodes 106 are in a rectangular shape and the longitudinal sides extend in the direction X1 (or X2).

The individual electrodes 105 are formed within the displacement portions 41*a*. The individual electrodes 105 are electrically connected to the ends 101*a* of the individual electrode layers 101. The individual electrodes 105 are provided independently of each other. The rear common electrodes 106 are provided at the upper and lower ends of the rear surface 41*d* of the piezoelectric unit 41. The rear common electrodes 106 are electrically connected to the end 104*b* of the routing wire pattern 104.

As shown in FIG. 9C, terminals 111 of a flexible printed circuit cable 110 extending from the drive circuit (not shown) are provided adjacent to the individual electrodes 105 and the rear common electrodes 106 on the rear surface 41*d* of the piezoelectric unit 41. When the ink-jet head 20 is assembled, the terminals 111 of the flexible printed circuit cable 110 are soldered to the individual electrodes 105 and the rear common electrodes 106 on the rear surface 41*d* of the piezoelectric unit 41. In the present embodiment, the electrodes of the piezoelectric unit 41 and the terminals of the flexible printed circuit cable 110 are located on the rear surface 41*d*, and it is possible to easily perform the electrical connections between the ink-jet head 20 and the drive circuit.

The above-described embodiments of the present invention are applied to a piezoelectric-type ink-jet head. However, the present invention is not limited to a specific method of generating the energy needed to discharge ink. The present invention is also applicable to a thermal-type ink-jet head.

Further, the present invention is not limited to the above-described embodiments, and variations and modifications may be made without departing from the present invention.

What is claimed is:

1. An ink-jet head, comprising:

a holder having a rectangular frame said rectangular frame having an upper side with upper ribs extending downwardly from said upper side and spaced apart from each other along said upper side and a lower side with lower ribs extending upwardly from said lower side and spaced apart from each other along said lower side, said upper ribs and said lower libs having corresponding first reference side surfaces arrayed at a predetermined pitch in a main scanning direction; and a plurality of segment chips held on said holder, each of said plurality of segment chips having an ink chamber plate and nozzles, each of said ink chamber plates having a flat surface on which grooves forming ink chambers are arrayed in a row perpendicular to the main scanning direction, said each of said ink chamber plates having second reference side surfaces each extending from and coplanar with said flat surface, wherein said second reference side surfaces of each of said ink chamber plates are in contact with said corresponding first reference side surfaces of said holder so that said nozzles of said respective segment chips are positioned on said holder at the predetermined pitch in the main scanning direction, and said plurality of segment chips are fixed to said holder.

2. The ink-jet head according to claim 1, wherein each of said plurality of segment chips comprises a piezoelectric unit, said piezoelectric unit being fixed to said flat surface of one of said ink chamber plates, said piezoelectric unit having stress-generating-portions arrayed in the main scanning direction and respectively confronting said grooves on said flat surface.

3. The ink-jet head according to claim 2, wherein said second reference side surface of each of said ink chamber plates extends from and is exposed to said piezoelectric unit.

4. The ink-jet head according to claim 2, wherein each of said stress-generating-portions of said piezoelectric unit includes electrodes electrically connected to a drive circuit of a printer.

5. The ink-jet head according to claim 2, wherein said piezoelectric unit comprises:

a front surface;

a rear surface;

individual electrode layers individually provided for each of said stress-generating-portions, said individual electrode layers extending to said rear surface having respective ends on said rear surface;

common electrode layers provided for each of said stress-generating-portions and formed alternatively with said individual electrode layers, said common electrode layers extending to said front surface and having respective ends of said front surface;

a front common electrode formed on said front surface, said front common electrode electrically connected to said ends of said common electrode layers;

a routing wire pattern for routing said front common electrode from said front surface to said rear surface, said routing wire pattern electrically connected to said front common electrode and extending to said rear surface, said routing wire pattern having an end exposed on said rear surface;

individual electrodes individually provided for each of said stress-generating-portions and formed on said rear surface, said individual electrodes electrically connected to said ends of said individual electrode layers; and a rear common electrode formed on said rear surface, said rear common electrode electrically connected to said end of said routing wire pattern on said rear surface.

6. The ink-jet head according to claim 1, wherein each of said plurality of segment chips comprises a nozzle plate, said nozzle plate having said nozzles arrayed in a row and formed in said nozzle plate, said nozzle plate being fixed to said ink chamber plate so that said nozzles of said nozzle plate respectively confront said ink chamber plate.

7. The ink-jet head according to claim 1, wherein each of said plurality of segment chips comprises a nozzle plate, said nozzle plate having locating holes formed in line with and outside said nozzles of said nozzle plate, and said ink chamber plate having locating grooves formed parallel to and outside said grooves of said ink chamber plate.

8. The ink-jet head according to claim 7, wherein said nozzles of said nozzle plate are positioned on said ink chamber plate by fitting said locating holes of said nozzle plate to said locating grooves of said ink chamber plate.

9. The ink-jet head according to claim 7, wherein a distance between a centerline of said nozzles of said nozzle plate and said flat surface of each of said ink chamber plates in the main scanning direction is set to be a predetermined dimension.

10. An ink-jet head, comprising:

a holder having a rectangular frame, said rectangular frame having an upper side with upper ribs extending downwardly from said upper side and spaced apart from each other along said upper side and a lower side with lower ribs extending upwardly from said lower side and spaced apart from each other along said lower side, said upper ribs and said lower libs having corresponding first reference side surfaces arrayed at a predetermined pitch in a main scanning direction; and a plurality of segment chips held on said holder, each of said plurality of segment chips having an ink chamber plate, each of said ink chamber plates having a flat surface on which grooves forming ink chambers are arrayed in a row perpendicular to the main scanning direction, each of said ink chamber plates having second reference side surfaces each extending from and coplanar with said flat surface, a common nozzle plate fixed to said plurality of segment chips, said common nozzle plate having nozzles arrayed in rows, said nozzles for one of said rows confronting the grooves on said flat surface of one of said ink chamber plates of a corresponding one of said plurality of segment chips, wherein said second reference side surfaces of each of said ink chamber plates are in contact with said corresponding first reference side surfaces of said holder so that said nozzles of said common nozzle plate are positioned on said holder at the predetermined pitch in the main scanning direction, and said plurality of segment chips are fixed to said holder.

11. A method of manufacturing an ink-jet head, comprising the steps of:

preparing a holder having a rectangular frame, said rectangular frame having an upper side with upper ribs extending downwardly from said upper side and spaced apart from each other along said upper side and a lower side with lower ribs extending upwardly from said lower side and spaced apart from each other along said lower side, said upper ribs and said lower libs having a corresponding first reference surfaces arrayed at a predetermined pitch in a main scanning direction; and preparing a plurality of segment chips, each of said plurality of segment chips having an ink chamber plate and nozzles, each of said ink chamber plates having a flat surface on which grooves forming ink chambers are arrayed in a row perpendicular to the main scanning direction, said each of said ink chamber plates having a second reference surface extending from and coplanar with said flat surface;

positioning said nozzles of said respective segment chips on said holder at the predetermined pitch in the main scanning direction by placing said second reference surfaces of said ink chamber plates of said plurality of segment chips into contact with said first reference side surfaces of said holder; and fixing said plurality of segment chips to said holder.

* * * * *